United States Patent [19]

Loda

[11] Patent Number: 4,977,392

[45] Date of Patent: Dec. 11, 1990

[54] SECURITY ALARM SYSTEM AND SWITCH

[76] Inventor: Michael A. Loda, 2219 Walnut Ct., Hanover Park, Ill. 60103

[21] Appl. No.: 351,542

[22] Filed: May 15, 1989

[51] Int. Cl.[5] ..... G08B 13/08; G08B 13/14

[52] U.S. Cl. ..... 340/568; 200/61.41; 200/61.93; 340/516; 340/545; 340/546

[58] Field of Search ..... 340/545, 546, 516, 384 E, 340/568, 686; 200/61.41, 61.93, 61.62, 61.81, 335, 329; 267/74, 73, 69

[56] References Cited

U.S. PATENT DOCUMENTS

| | | | |
|---|---|---|---|
| 3,797,006 | 3/1974 | Reininger | 340/545 |
| 3,995,268 | 11/1976 | Ferrari | 340/384 E |
| 4,030,087 | 6/1977 | Ritchie et al. | 340/516 |
| 4,212,300 | 7/1980 | Meals | 267/74 |
| 4,641,054 | 2/1987 | Takahata et al. | 340/384 E |
| 4,688,023 | 8/1987 | McGill et al. | 340/545 |
| 4,701,702 | 10/1987 | Krüger | 324/158 P |

*Primary Examiner*—Glen R. Swann, III
*Attorney, Agent, or Firm*—Douglas B. White

[57] ABSTRACT

Generally there is provided a cabinet alarm device having a protruding switch lever arm arranged such that it is held open during closure of a cabinet door, but is allowed to close when the cabinet door is opened. The switch is pivotally mounted and urged toward its closed positionby a spring under tension, such as a rubber strip or O-ring fixed to the switch arm and alarm case. This switch controls power to the electronic circuit which includes two oscillator and two controlling comparators. A first oscillator drives an annunciator at a preset high resonant frequency, while a second oscillator operating at a low frequency pulsates the tone. A first controlling comparator circuit operates to disable the tone circuit after a fixed time delay to allow an audible battery check during that delay but preventing further tone unless the circuit is energized for a longer period. A second controlling comparator disables the first comparator and thereby enables the alarm circuit after a preset longer delay or upon detection of sufficient multiple operations.

12 Claims, 3 Drawing Sheets

FIG. 1
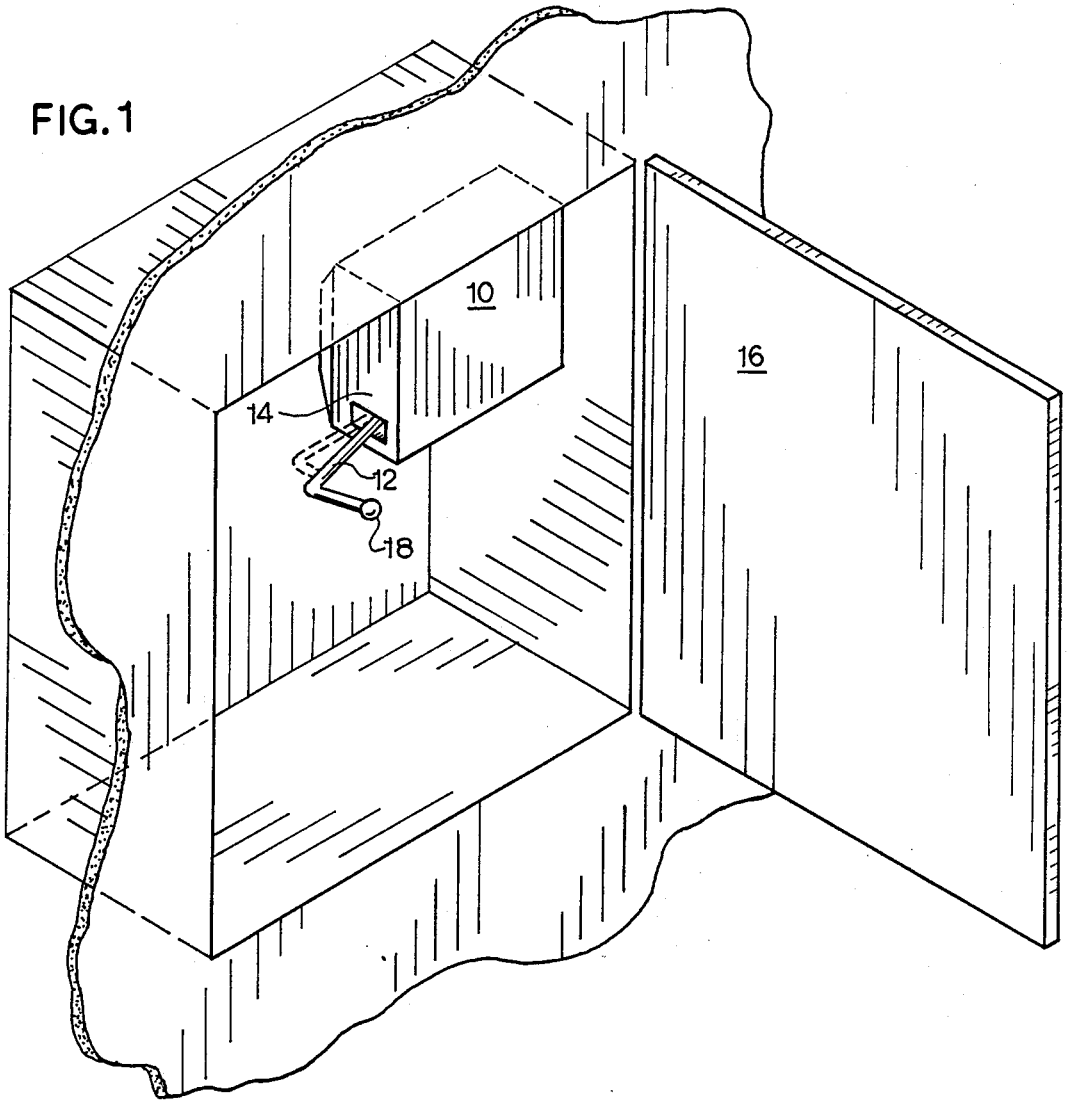
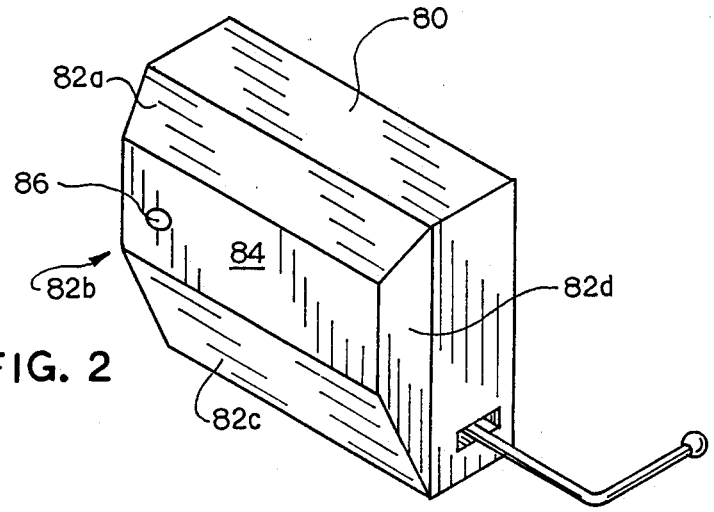
FIG. 2

FIG. 4
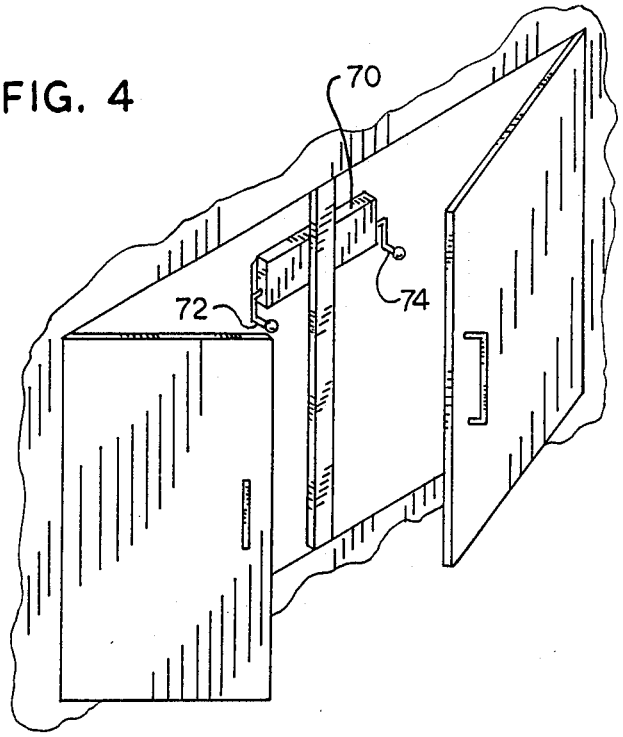
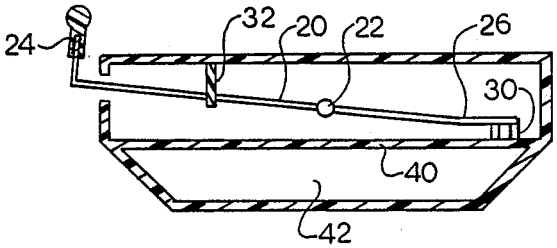
FIG. 3

SECURITY ALARM SYSTEM AND SWITCH

BACKGROUND OF THE INVENTION

1. Field of the Invention

This invention relates generally to security alarms and actuating switches. More particularly the invention relates to improvements in the alarms and switches of such systems to provide reliable and effective operation, particularly in the case of cabinet security and other applications for detecting movement of an object.

2. Description of the Prior Art

Security alarms, particulary for cabinets, have been proposed whereby a switch is tripped by the opening of a door. The switeh completes a circuit and thereby activates an alarm. Improvements have included a delayed alarm to allow an individual time to deactivate the system during authorized entry.

Recent improvements have included means to adapt such systems to monitor child access to cabinets. In U.S. Pat. No. 3,797,006 such a system is proposed which incorporates a time delay. A spring loaded plunger switch is connected to switch power to an electronic control for an alarm. The electronic control operates to sound the alarm after a preset time delay. More recently in U.S. Pat. No. 4,688,023 a drawer alarm was proposed which uses a pivoting switch normally held in the closed position by a compressed coil spring. When the drawer is closed, the switch is held open; but when the drawer is opened the compressed spring expands to close the circuit and sound the alarm. Notwithstanding, these prior efforts, improvements were still needed in the available operational features and reliability of such systems.

SUMMARY OF THE INVENTION

Accordingly, it is a principal objective of the present invention to provide a cabinet alarm device which uses a lever arm controlled by spring means operable under tension instead of compression.

It is a further object to provide such an alarm system which automatically provides a battery check and a brief early warning of unauthorized entry.

It is yet a further object to provide electronic memory of repeated openings of a cabinet door to sound the alarm after repeated, although brief, openings.

It is another object to provide a pulsating alarm tone to improve its recognition.

It is yet another object to provide a sound enhancing acoustically shaped enclosure for the alarm, of a size adaptable to many uses and which exhibits an adjustable trigger arm.

It is still a further object to provide an alarm system which is smaller and more economical than prior systems and which may incorporate multiple switches for monitoring of multiple doors.

It is finally an objective to provide an electronic control which automatically resets after operation, and which operates the alarm at its resonant frequency for maximum battery charge conservation.

Generally there is provided a cabinet alarm device having a protruding switch lever arm arranged such that it is held open during closure of a cabinet door, but is allowed to close when the cabinet door is opened. The switch is pivotally mounted and urged toward its closed position by a spring under tension, such as a rubber strip or O-ring fixed to the switch arm and alarm case. This switch controls power to the electronic circuit which includes two oscillators and two controlling comparators. A first oscillator drives an annunciator at a preset high resonant frequency, while a second oscillator operating at a low frequency pulsates the tone. A first controlling comparator circuit operates to disable the tone circuit after a fixed time delay to allow a battery check tone during that delay but preventing further audible output unless the circuit is energized for a longer period. A second controlling comparator disables the first comparator and thereby enables the alarm circuit after a longer preset delay or upon detection of sufficient multiple operations.

BRIEF DESCRIPTION OF THE DRAWINGS

FIG. 1 is a perspective view of the alarm system of the present invention depicting an alarm housing mounted within a cabinet and showing an actuating lever arm controlled by movement of the cabinet door.

FIG. 2 is a perspective view of the alarm of the present invention viewed from the rear side showing the acoustically shaped housing for enhancing the audible output.

FIG. 3 is a sectional view of the switch mechanism of the present invention.

FIG. 4 is a perspective view of a dual-door adaptation of the alarm of the present invention.

Figure 5:
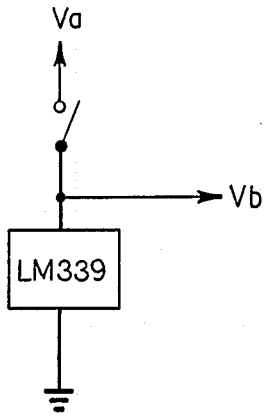
FIG. 5 is a schematic of the switch circuitry of the alarm.

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims. More particularly, it is understood that this device may be adapted to drawers, doors, boxes, or any instance where movement of an object allows the responsive movement of the switch arm.

DESCRIPTION OF THE PREFERRED EMBODIMENT

Turning now to the drawings, and particularly FIG. 1, there is shown a cabinet alarm 10 in accordance with the present invention positioned within a cabinet proximate the cabinet opening. The alarm is preferrably secured to the cabinet by attachment means, and typically the housing of the alarm is affixed by adhesive or screw means to an internal portion of the cabinet, such as the top of the cabinet (as shown in FIG. 1).

The alarm device employs a switch arm 12 protruding from the housing 14 and arranged to contact the cabinet door 16 at its extremity. The extremity may carry a contact member 18 to project a smooth curved surface to the cabinet door and facilitate sliding movement therebetween.

Reference now being made to FIG. 3, the novel switch mechanism of the present invention is shown most clearly. This mechanism includes a switch arm 20 pivotally mounted to the housing proximate its center 22. At the protruding extremity there is provided an adjustable member 24 having screw threads for selective positioning on the lever arm. This allows adjustment to accommodate deep mountings of the alarm to bring the lever arm out to meet the cabinet door. At the internally positioned extremity of the lever arm there is provided an electically conductive portion 26 arranged to close the switch contacts 30. This lever arm is spring biased about its pivot, urging the lever toward closure of the contacts and bringing the protruding extremity forward. This biasing may be in the form of an axial coil spring, or as shown in FIG. 3 it may consist of an O-ring 32 stretched between the housing and the lever arm. Upon closure of the cabinet door the protruding extremity is pressed rearward, further stretching the O-ring and raising the electrical contact portion 26 of the lever to open the circuit. Upon opening of the door, the O-ring pulls the lever arm forward and closes the switch contacts.

In the preferred embodiment, the switch controls power to an electronic circuit (as shown in FIG. 5) mounted on a printed circuit board 40 positioned within the housing and having a battery mounted within the housing enclosure 42. The circuitry includes commonly known comparators (and is designed to conveniently use one LM 339 chip) and also includes a commonly employed annuniciator device. The switch mechanism of the alarm, in accordance with the invention, switches power from the battery, represented as $V_a$ in FIG. 5, to provide a switched power $V_b$ to the LM 339.

Figure 6:
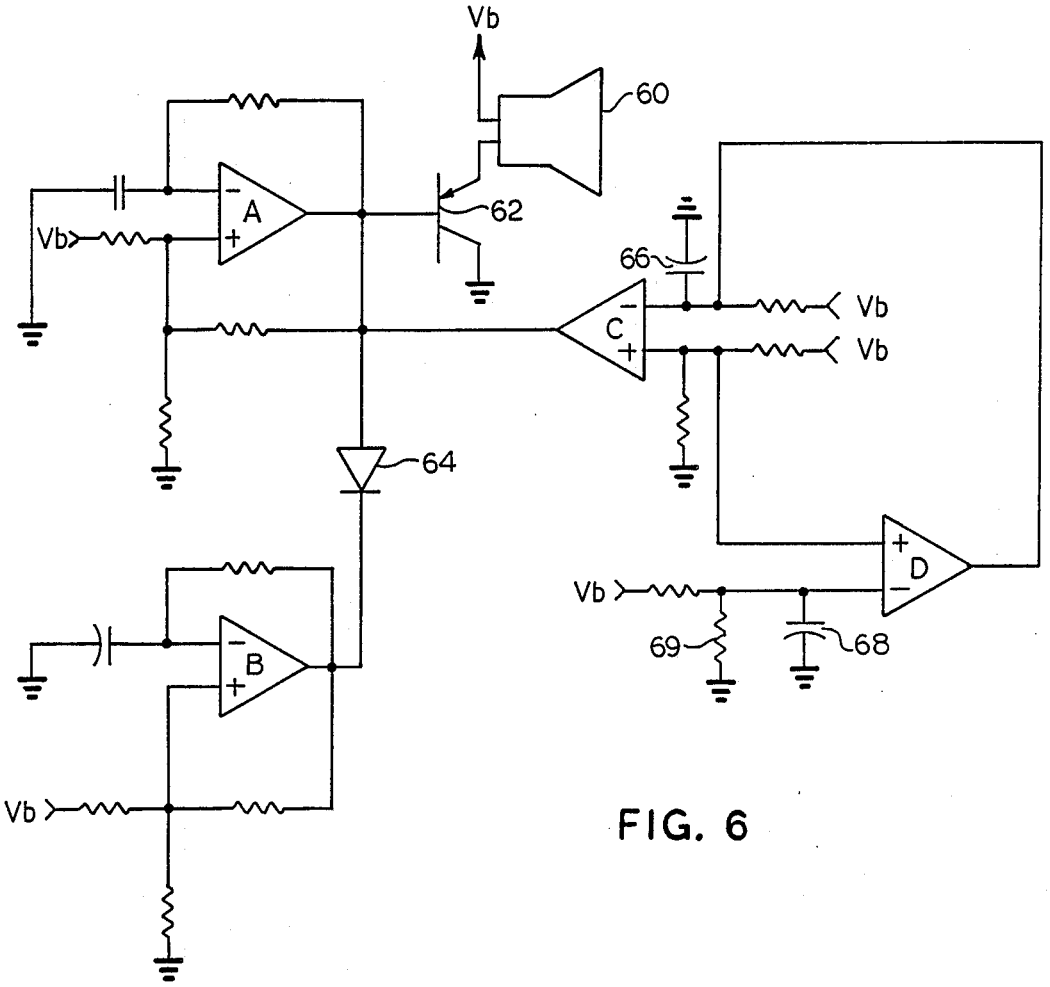
FIG. 6 is a schematic of the oscillator, comparator and annunciator circuits of the alarm.

As shown in the schematic of FIG. 6, the annunciator device 60 is operated by a high frequency oscillator formed with the comparator A to provide a square wave of about 2 khz to a transistor 62 positioned to drive the annunciator. A second low frequency oscillator formed with comparator B is set to provide a 2 hz square wave to the diode 64. When this signal is low it disables the high frequency oscillator by pulling the signal at its output low. As a result this causes a pulsating tone which functions to attract greater attention to the alarm.

Comparator C is positioned to disable the high frequency oscillator after a short period of time (such as0.4 sec.). When power is first switched "ON", the high frequency oscillator generates an output tone; but when the capacitor 66 has had time to charge, the output of comparator C goes low to disable the oscillator. This sequence allows for a brief initial circuit check but prevents the full alarm unless the "Power On" condition is maintained for a longer duration. Since the charge on capacitor 66 drains off quickly the circuit automatically resets between operations.

Comparator D is positioned to disable comparator C and cause a high comparator C output after a set time delay. This delay is determined by the time necessary to charge capacitor 68 past the threshold required to bring the output of comparator D low. Consequently comparator D measures the time duration of the door opening and causes the audible alarm to resume after the door is open for that preset time. In a further feature, the capacitor 68 drains off slowly through the high resistance 69 between repeated operations and as a result responds to repeated, although brief, door openings. This repeated door opening is a well known behavioral pattern for young children and is recognized by this circuit. Each time the door is opened and power is applied to the capacitor 68 the charge continues to build until the comparator D output disables comparator C to thereby allow the oscillators to operate the alarm continuously.

In a further feature of the invention, a single alarm may employ multiple or ganged switches and positioned to sense the position of more than a single cabinet door. As shown in FIG. 4 a single unit 70 having dual switches of the type in accordance with this invention is depicted mounted at the center of a dual door cabinet. This unit presents independently moveable switch arms 72 and 74 arranged to contact the cabinet doors in the manner previously described. Consequently, movement of either door causes the single alarm circuit to operate as previously described.

In yet a further feature of the invention, the alarm housing is shaped to improve the acoustical properties of the alarm. Reference now being made specifically to FIG. 2, a base portion 80 of the housing serves to mount the lever arm and allow its reciprocal travel. The alarm annunciator is mounted within the housing intermediate the converging faces 82*a–d*, proximate the back face 84, and near one extremity at the location indicated by numeral 86. When the annunciator is driven the sound is redirected by these faces to improve the audibility of the alarm. Moreover, the annunciator in the preferred embodiment is driven at its resonant frequency by selection of appropriate circuit elements and this can be matched with the acoustical impedance of the housing to improve its operation.

From the foregoing description, it will be apparent that modifications can be made to the apparatus and method for using same without departing from the teachings of the present invention. Accordingly, the scope of the invention is only to be limited as necessitated by the accompanying claims.

I claim:

1. An alarm system for detection of the movement of an object comprising:

a housing;

a lever arm having a sensing extremity and a contact extremity, said lever arm being pivotally mounted intermediate said extremities;

extensible means under tension affixed to said housing and said lever arm for urging said lever arm about said pivot and causing said contact extremity to close electrical contacts; and electronic means for generating a pulsating audible tone upon closing of said electrical contacts, said electronic means including;

an annunciator device, a first oscillator circuit coupled to said annunciator to generate a tone therefrom, and a second oscillator for periodically disabling said first oscillator to provide a pulsing effect, and said electronic means further comprising;

a first timing circuit for disabling said first oscillator circuit after a first set time delay and a second timing circuit for enabling said first oscillator after a second set time delay.

2. An alarm system for detection of movement of an object of claim 1 wherein said first timing circuit comprises a comparator circuit having an RC charging circuit connected to one input for controlling the timing of the change of its output signal.

3. An alarm system for detection of movement of an object of claim 2 wherein said second timing circuit comprises a comparator circuit having an RC charging circuit connected to one input for controlling the timing of the change of its output signal, and wherein said second timing circuit is arranged to disable said first timing circuit after said second time delay.

4. An alarm system for detection of movement of an object comprising:

a housing exhibiting a multi-side shape having a plurality of sides angled toward convergence, whereby acoustical properties of said housing are enhanced;

a lever arm having a sensing extremity and a contact extremity, said lever arm being pivotally mounted intermediate said extremities;

extensible means under tension affixed to said housing and said lever arm for urging said lever arm about said pivot and causing said contact extremity to close electrical contacts; and electronic means for generating an audible tone upon closing of said electrical contacts.

5. An alarm system for detection of movement of an object comprising:

a housing;

a lever arm having a sensing extremity and a contact extremity, said lever arm being pivotally mounted intermediate said extremities and having means for adjusting the protruding dimension of said sensing extremity;

extensible means under tension affixed to said housing and said lever arm for urging said lever arm about said pivot and causing said contact extremity to close electrical contacts; and electronic means for generating an audible tone upon closing of said electrical contacts.

6. An alarm system for detection of movement of an object comprising:

a housing;

a lever arm having a sensing extremity and a contact extremity, said lever arm being pivotally mounted intermediate said extremities, and wherein said sensing extremity of said lever arm further comprises a curved member to provide smooth sliding contact with said object;

extensible means under tension affixed to said housing and said lever arm for urging said lever arm about said pivot and causing said contact extremity to close electrical contacts; and electronic means for generating an audible tone upon closing of said electrical contacts.

7. An alarm system for detection of movement of a plurality of objects comprising:

a housing;

a plurality of lever arms, each lever arm having a sensing extremity and a contact extremity, each of said lever arms being pivotally mounted intermediate said extremities;

extensible means under tension affixed to said housing and to each of said lever arms for urging said lever arms about said pivots and causing said contact extremities to close electrical contacts; and electronic means for generating a pulsating audible tone upon closing of any of said electrical contacts, said electronic means including;

an annunciator device, a first oscillator circuit coupled to said annunciator to generate a tone therefrom, and a second oscillator for periodically disabling said first oscillator to provide a pulsing effect, and said electronic means further comprising;

a first timing circuit for disabling said first oscillator circuit after a first set time delay; and a second timing circuit for enabling said first oscillator after a second set time delay.

8. An alarm system for detection of movement of a plurality of objects of claim 7 wherein said first timing circuit comprises a comparator circuit having an RC charging circuit connected to one input for controlling the timing of the change of its output signal.

9. An alarm system for detection of movement of a plurality of objects of claim 8 wherein said second timing circuit comprises a comparator circuit having an RC charging circuit connected to one input for controlling the time of the change of its output signal, and wherein said second timing circuit is arranged to disable said first timing circuit after said second time delay.

10. An alarm system for detection of movement of a plurality of objects comprising:

a housing exhibiting a multi-sided shape having a plurality of sides angle toward convergence, whereby acoustical properties of said housing are enhanced;

a plurality of lever arms, each lever arm having a sensing extremity and a contact extremity, each of said lever arms being pivotally mounted intermediate said extremities;

extensible means under tension affixed to said housing and to each of said lever arms for urging said lever arms about said pivots and causing said contact extremities to close electrical contacts; and electronic means for generating an audible tone upon closing of any of said electrical contacts.

11. An alarm system for detection of movement of a plurality of objects comprising:

a housing;

a plurality of lever arms, each lever arm having a sensing extremity and a contact extremity, each of said lever arms being pivotally mounted intermediate said extremities and having means for adjusting the protruding dimension of said sensing extremity;

extensible means under tension affixed to said housing and to each of said lever arms for urging said lever arms about said pivots and causing said contact extremities to close electrical contacts; and electronic means for generating an audible tone upon closing of any of said electrical contacts.

12. An alarm system for detection of movement of a plurality of objects comprising a housing;

a plurality of lever arms, each lever arm having a sensing extremity and a contact extremity, each of said arms being pivotally mounted intermediate said extremities and wherein said sensing extremities of said lever arms further comprise a curved member to provide smooth sliding contact with said object;

extensible means under tension affixed to said housing and to each of said lever arms for urging said lever arms about said pivots and causing said contact extremities to close electrical contacts; and electronic means for generating an audible tone upon closing of any of said electrical contacts.

* * * * *